US006220928B1

(12) United States Patent
Okabe et al.

(10) Patent No.: US 6,220,928 B1
(45) Date of Patent: Apr. 24, 2001

(54) SURFACE GRINDING METHOD AND APPARATUS FOR THIN PLATE WORK

(75) Inventors: Keiichi Okabe, Nagano; Hisashi Oshima, Niigata; Sadayuki Okuni; Tadahiro Kato, both of Nishigo, all of (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 09/301,348

(22) Filed: Apr. 29, 1999

(30) Foreign Application Priority Data

May 6, 1998 (JP) ..... 10-123282

(51) Int. Cl.[7] ..... B24B 49/00
(52) U.S. Cl. ..... 451/5; 451/287; 451/288
(58) Field of Search ..... 451/5, 287, 288, 451/11

(56) References Cited

U.S. PATENT DOCUMENTS 5,074,079 * 12/1991 Park .
5,077,941 * 1/1992 Whitney .
5,454,921 10/1995 Kogure .
5,700,180 * 12/1997 Sandhu et al. .
5,816,895 * 10/1998 Honda .
5,904,608 * 5/1999 Watanabe .
5,911,619 * 6/1999 Uzoh et al. .
6,074,281 * 1/2000 Swanson et al. .

FOREIGN PATENT DOCUMENTS 272 531 A1 6/1988 (EP) .
9-85619 3/1997 (JP) .

* cited by examiner

*Primary Examiner*—Timothy V. Eley
*Assistant Examiner*—Willie Berry, Jr.
(74) *Attorney, Agent, or Firm*—Evenson, McKeown, Edwards & Lenahan, P.L.L.C.

(57) ABSTRACT

The present invention provides a surface grinding method and apparatus for achieving a thin plate work such as a semiconductor wafer with high flatness, high accuracy and certainty and the apparatus comprises: a surface grinder in which a grinding wheel support member 3 by which a rotary shaft 5 of a grinding wheel 6 is supported is held by a pivotal shaft portion 4 and a grinding wheel shaft inclination control motor 9 which displaces the grinding wheel support member 3 by activating the pivotal shaft portion 4 is provided; a corrective angle storage device 15 which stores a corrective angle of an inclination angle of a rotary shaft 5 of the grinding wheel 6 to a rotary shaft 13 of a wafer 12; and a shaft inclination control apparatus 14 which sends out a signal to control the grinding wheel shaft inclination control motor 9 while reading a corrective angle of the corrective angle storage device 15, wherein a relative inclination angle of the grinding wheel to the thin plate work, in a more concrete manner an inclination angle of the rotary shaft 5 of the grinding wheel 6, is changed for each of grinding steps of high rate feed, low rate feed and spark-out.

4 Claims, 4 Drawing Sheets

SURFACE GRINDING METHOD AND APPARATUS FOR THIN PLATE WORK

BACKGROUND OF THE INVENTION

1. Field of the Invention

The present invention relates to a surface grinding method and apparatus for a thin plate work and particularly, to a surface grinding method and apparatus for a thin plate work such as a semiconductor wafer.

2. Description of the Prior Art

A mirror wafer is generally attained by sequentially performing the following steps of: chamfering for preventing the peripheral region of a wafer which is obtained after passing through a slicing step from chipping; lapping for eliminating a variation in thickness of the wafer; etching for removing a damaged layer and a contaminated portion (where abrasive grains are incorporated); and polishing the chamfered portion of the peripheral region and a major surface of the wafer.

In recent years, a change has occurred in the processing process to attain a mirror wafer, in which change the lapping and etching steps are omitted and instead a grinding step is adopted, whereby a wafer is obtained in a state of being flat to high accuracy and no variation in thickness.

As a processing technique to flatten a wafer, surfacegrinding using a surface grinder has heretofore been known. In the surface grinder, an object to be processed is fixedly held on a rigid chuck table such as a porous ceramic plate and the like, a parallelism between a surface of the object to be processed and a grindstone is adjusted and thereafter, the grinding wheel which rotates is pressed on the wafer to grind off the surface portion of the object to be processed.

In the semiconductor industry, high precision in a silicon wafer, which is an object to be processed, has been demanded: for example, extremely high flatness having a value of 2 $\mu$m or less in flatness called TTV (Total Thickness Variation) has been required for a wafer of 200 mm in diameter.

In recent years, an infeed type surface grinder in which a grinding wheel of a cup-shape is set has been used in response to requirement for a wafer surface of high flatness and grinding method has been developed in which a grinding wheel is continuously fed into a silicon wafer to grind while the silicon wafer is rotated about its center at a high speed.

In such a grinding method, a silicon wafer 12 is mounted so that the center of the silicon wafer 12 almost coincides with a rotation center of a rotary table 11 as shown in FIG. 5.

On the other hand, the grinding wheel 6 of a cup-shape is located so that a rotation center of the silicon wafer 12 comes in a working area of the grinding wheel 6.

In this situation, when a relative feed movement is given to the grinding wheel 6 of a cup-shape and the silicon wafer 12 along a direction perpendicular to a working surface being ground while rotating both of the silicon wafer 12 and the cup wheel 6, whole surface of the silicon wafer 12 can be ground without any movement in the grinding plane.

In order to enable high flatness grinding on a wafer, a feed rate of the grinding wheel of a cup-shape is changed in at least three stages, that is high rate feed (depth of cut in grinding), low rate feed (depth of cut) and spark-out (no feed).

However, the following problem still remains in such a conventional technique.

That is, in the grinding method, circumferential speeds in the central portion and the peripheral region of a wafer are different from each other due to wafer rotation about its center; a trace of bending in the shaft of a grinding wheel which rotates the grinding wheel occurs in combination of the speed difference with grinding resistance due to an feed rate of the grinding wheel. The grinding wheel is inclined toward the center side of a wafer surface by the bending and a fault thereby occurs that the wafer and the grinding wheel cannot be maintained in a horizontal plane.

Besides, since, in wafer grinding processing, a high flatness grinding is effected while changing a feed rate (depth of cut) of a grinding wheel of a cup-shape in at least three stages of high rate feed, low rate feed and spark-out (no feed), a further problem occurs that an inclination angle of the grinding wheel also changes according to a change in a grinding wheel feed rate (depth of cut).

The problem will be explained using diagramatic forms in FIGS. 3 and 4. While in the following explanation, three stage feed pattern is shown as an example, there is no specific limitation to the pattern but two stage or more than three stage feed pattern can be adopted.

In FIGS. 3 (*a*) to 3(*b*), a grinding wheel 6 drawn in a solid line shows actual grinding postures thereof in operations of various feed rates (depth of cut), while a grinding wheel 6*a* drawn in a dotted line shows an initial posture when the grinding wheel 6*a* is set in a surface grinding apparatus. Differences in posture are originated from bending of the shaft of the grinding wheel due to grinding resistance and the like, though the postures essentially coincide with each other if the shaft of the grinding wheel is perfectly rigid.

In the first stage feed of FIG. 3(*a*), a high rate feed (depth of cut) is adopted taking securement of grinding start and productivity into consideration. At this point, cutting by the grinding wheel 6 occurs toward the c nter portion of a wafer 12 due to grinding resistance which the grinding wheel 6 receives from the wafer and circumferntial speeds in the wafer, the rotary shaft of the grinding wheel is bent corresponding to the cutting and as a result and the grinding wheel 6 is inclined to the central side, so t at ground stock removal in the central side of the wafer s increased as compared with the peripheral region thereof and the wafer 12 comes to have a shape of strong concavity in the ground surface.

Subsequently to the high rate feed, low rate feed (depth of cut) shown in FIG. 3(*b*) follows in order to enable grinding accuracy on the wafer 12 to be secured with ease. At this point, grinding resistance of the wafer 12 against the grinding wheel 6 is reduced and a bending f the grinding wheel shaft is also decreased in conformity with this, so that inclination of the grinding wheel shaft toward the central side is alleviated, which causes reduction in ground stock removal in the central side of the wafer 12, whereas the inclination of the grinding wheel toward the central side continues and thereby concavity of the wafer 12 is retained, though being shallow.

Further, in FIG. 3(*c*), no-feed grinding called spark-out is performed. Influences of changes in stress of the apparatus and the material are thereby removed to secure accuracy, but the concave shape of the wafer 12 cannot perfectly be eliminated.

To sum up, as a feed rate (depth of cut) is higher in the initial period of grinding, a trend in which the center of a wafer 12 is more removed happens, so that a shape of the wafer 12 after grinding assumes a bowl-like shape. That is, as a higher feed rate is selected in order to secure higher productivity, a trend for the wafer 12 to assume a bowl-like shape is stronger, so that not only are a time to be spent in the low rate feed and a time to be spent in the spark-out both required to flatten the wafer 12 longer, but the bowllike shape of the wafer 12 cannot be erased with ease, even though spark-out is applied.

Therefore, in a comparative example of the present invention, which is general correction means, as shown in FIGS. 4(*a*) to 4(*c*), a posture of the grinding wheel 6 is not positioned horizontal, but in a reverse way corrected being inclined to the peripheral side based on a bowl-like shape of the wafer 12 in spark-out before starting grinding: in a more concrete manner, a grinding wheel posture is initially set so as to correct in the concavity direction by 1 μm based on a shape of after grinding, and then a grinding process to achieve the wafer 12 with high flatness is conducted while changing feed rates (depth of cut) in three stages: high rate feed, low rate feed and spark-out (no feed).

According to such a comparative example, concavities after the high rate feed and low rate feed are decreased by the correction of inclination in posture before the grinding and respectively resulted in 2.5 μm in case of high rate feed and 0.5 μm in case of low rate feed and high flatness can theoretically be secured by grinding 0.5 μm in thickness in spark-out.

However, even in the conventional technique in which correction is effected prior to the grinding in such a manner, the spark-out grinding requires about 10 revolutions and there has been a chance to require a long grinding time in order to correct a bowl-like shape of 0.5 μm, though one or two revolutions are essentially enough. The reason why a grinding time is increased is that a trace of a bowl-shape remains on the working surface even after the low rate feed and the spark-out which essentially plays a role to improve surface finish without any intentional feed has to be utilized to recover a flatness and conduct grinding of a cut depth of 0.5 μm.

Grinding of a wafer 12 in a bowl-like shape and a longer grinding time increases a load imposed on a grinding wheel 6, a working surface of the grinding wheel is worn and loading or grazing, in which no self-truing action for restoration of a cutting ability is exercised, occurs on or in the grinding wheel. A grinding wheel already in such conditions cannot recover an original cutting ability unless a surface portion of the grinding wheel is intentionally removed by abrasion in a process called dressing and this process has had a problem that a life time of the grinding wheel is shortened.

SUMMARY OF THE INVENTION

The present invention has been made in light of such technical problems and it is, accordingly, an object of the present invention to provide a surface grinding method and apparatus by which a thin plate work such as a semiconductor wafer with high flatness can be obtained with high accuracy and certainty.

In order to achieve such an object, the present invention is directed to a surface grinding method in which a grinding wheel of a cup-like shape, which rotates, is pressed on an object to be processed of a thin plate work, which rotates being supported on a table, and the thin plate work is ground while a feed rate of the grinding wheel is changed stepwise, characterized by that a relative angle of inclination of the grinding wheel to the thin plate work, that is an inclination angle of a rotary shaft of the object to be processed to a rotary shaft of the grinding wheel, is changed almost in synchronization with a time at which a feed rate in grinding is changed.

Herein, what is meant by the term, almost in synchronization, is that a change in feed rate and a change in inclination angle does not perfectly coincide with each other in timing, but the change in feed rate may slowly be progressed over a time span including before and after the change in inclination angle or vice versa.

The present invention is directed to a surface grinding method for a thin plate work in which a surface of the thin plate work is ground while a feed rate of the grinding wheel 6 in a cup-like shape is changed in multiple stages of high rate feed, low rate feed and spark-out (no feed), characterized by that a relative angle of the grinding wheel to the thin plate work is sequentially corrected to arbitrary angles (inclination corrective angles) which is stored in advance in a plurality of stages comprising the high rate feed, the low rate feed and the spark-out and the thin plate work is processed to a target shape.

For example, when the thin plate work 12 is processed to a horizontal (flat) shape, first, second and third inclination angles which are inclined downwardly to the peripheral side of the thin plate work 12 are set and the inclination angles are sequentially used for correction so that a selected inclination angle is closer to a horizontal direction.

While grinding in this case has a flat (horizontal) shape as a target shape, other shapes as a target shape can be considered: a convex shape and a concave shape, and in the cases of such shapes, too, grinding with good accuracy as in the case of a flat shape can be executed by, in the respective stages, setting corrective angles in advance and sequentially correcting the inclination angles.

In order to execute the present invention relating to the surface grinding method for a thin plate work in an effective manner, the present invention is directed to a surface grinding apparatus by which a grinding wheel of a cup-like shape, which rotates, is pressed on an object to be processed of a thin plate work, which rotates being supported on a table, and the thin plate work is ground while a feed rate of the grinding wheel is changed stepwise, characterized by that the apparatus comprises:

- grinding wheel feed rate adjustment means which can change a feed rate of the grinding wheel stepwise;
- corrective angle storage means for storing a corrective angle of an inclination angle of the grinding wheel for each of grinding steps corresponding to feed rates of the grinding wheel; and
- shaft inclination control means for controlling a relative angle of a shaft of the grinding wheel to a shaft on which the thin plate work is held according to a corrective angle which is read from the corrective angle storage means, wherein an inclination angle of the grinding wheel shaft is changed by the shaft inclination control means for each of the grinding steps corresponding to the feed rates of the grinding wheel.

In the mean time, the shaft inclination control means may control either the grinding wheel shaft or the thin plate work holding shaft, or both of the shafts in a combined manner.

Operations of the present invention will be described taking the case where a thin plate work is ground into a flat (horizontal) shape as an example.

As shown in FIGS. 3(*a*) to 3(*c*), in the case where a wafer is ground in conditions in which a rotary shaft of the grinding wheel 6 of a cup-like shape is set vertically and an inclination angle of the grinding wheel working surface to a wafer is set "0"(a horizontal state), shapes of the wafer which has actually been ground are all of a bowl with a concavity in the middle portion of about 3.5 μm in high rate feed (FIG. 3(*a*)), about 1.5 μm in low rate feed (FIG. 3(*b*)) and about 1 μm in spark-out (FIG. 3(*c*)). (the grinding has been performed with no correction of a inclination angle).

Therefore, the present invention seeks to obtain an inclination corrective angle from a shape of a wafer when the grinding is performed with no correction of inclination angle. That is, a grinding wheel inclination angle $\alpha_1$, in the high rate feed (depth of cut) is an angle corresponding to the shape of the wafer at 3.5 μm and, in a more concrete manner, is set so as to satisfy the following equation:

$$\tan \alpha_1=(3.5\ \mu m)/W$$

where W indicates the radius of a wafer.

In a similar manner, a grinding wheel inclination angle $\alpha_2$ in the low rate feed (depth of cut) is set so as to satisfy the following equation:

$$\tan \alpha_2=(1.5\ \mu m)/W$$

where W indicates the radius of a wafer.

Further, a grinding wheel inclination angle $\alpha_3$ in the spark-out is set so as to satisfy the following angle:

$$\tan \alpha_3=(1.0\ \mu m)/W$$

where W indicates the radius of a wafer.

The grinding wheel inclination angles $\alpha_1,\alpha_2,\alpha_3$ are stored in a corrective angle storage means which stores a corrective angle of a grinding wheel inclination angle.

As shown in FIG. 2, in the high rate feed, the grinding wheel 6 is inclined based on the grinding wheel inclination angle $\alpha_1$ which is read from the corrective angle storage means and the high rate feed is conducted in this state.

Then, in the low rate feed, the grinding wheel inclination angle is changed from $\alpha_1$ to $\alpha_2$ and thereafter, the low rate feed is conducted, or the low rate feed is conducted while the wheel inclination angle is slowly changed from $\alpha_1$ to $\alpha_2$ in parallel to transition to the low rate feed.

In the spark-out in the last stage, the grinding wheel inclination angle is changed from $\alpha_2$ to $\alpha_3$ and thereafter, the spark-out is conducted, or the spark-out is conducted while the wheel inclination angle is slowly changed from $\alpha_2$ to $\alpha_3$ in parallel to transition to the spark-out.

As a result, the grinding wheel 6 takes a horizontal posture in parallel to a wafer surface during the grinding of each grinding step (high rate feed, low rate feed and sparkout), as shown in section drawn in a solid line in FIGS. 2(*a*) to 2(*c*), and a wafer flatness in each grinding step was maintained very good and is equal to or less than 1 μm.

In FIGS. 2(*a*) to 2(*c*), sectional views 6*c*, 6*d* each drawn in a dotted line indicate postures of the grinding wheel 6 which are respectively corrected based on wafer shapes in the high rate feed and the low rate feed, while a sectional view 6*e* drawn in a dotted line indicates an initial posture (prior to grinding) of the grinding wheel 6 which is corrected based on a spark-out shape.

That is, according to the present invention, when a grinding wheel is subjected to correction of relative angles between the shaft of the grinding wheel and a work so that the grinding wheel takes the above described postures as setting conditions in each of grinding steps, that is in the high rate feed (depth of cut), the low rate feed (depth of cut) and the spark-out, postures of the grinding wheel during the grinding are in parallel to the work and a high flatness of the work can thus be maintained.

As a result, the spark-out grinding achieves a sufficient finish by about one to two revolutions and the essential function of the spark-out can be exerted.

Since a working surface of a grinding wheel is in parallel put into contact with a wafer surface without any local cut in the wafer surface, a load is dispersed across the entire surface of a grinding wheel and as a result, the grinding can be possible in which an auto-truing action for restoring a cutting ability is smoothly exercised.

A change in grinding wheel inclination angle may automatically be effected, or may manually be carried out.

A technique analogous to the present invention is disclosed in the published Unexamined Japanese Patent Application No. Hei 9-85619, in which technique a thickness of a wafer is detected by a non-contact sensor which is arranged above the wafer in a grinding step, an inclination direction and a magnitude of the inclination between a table which holds the wafer and a grinding wheel shaft are calculated based on the sensor detection value and posture control of the grinding wheel 6 is performed according to the state of inclination which is thus calculated.

However, there is substantially unavailable a practical sensor, whereby a wafer flatness equal to or less than 2 μm in TTV can be measured in a non-contact condition with a wafer, and which can be included in a grinding apparatus itself, and if such a sensor was available, a cost would be very high, which makes it impossible to turn the present invention with the sensor to industrially practical use. In the present invention, without use of such a sensor, high accuracy surface grinding can be realized based on a relation between a grinding feed rate (grinding resistance) and a shape of major surface of a work with ease.

DETAILED DESCRIPTION OF THE PREFERRED EMBODIMENT

Figure 5:
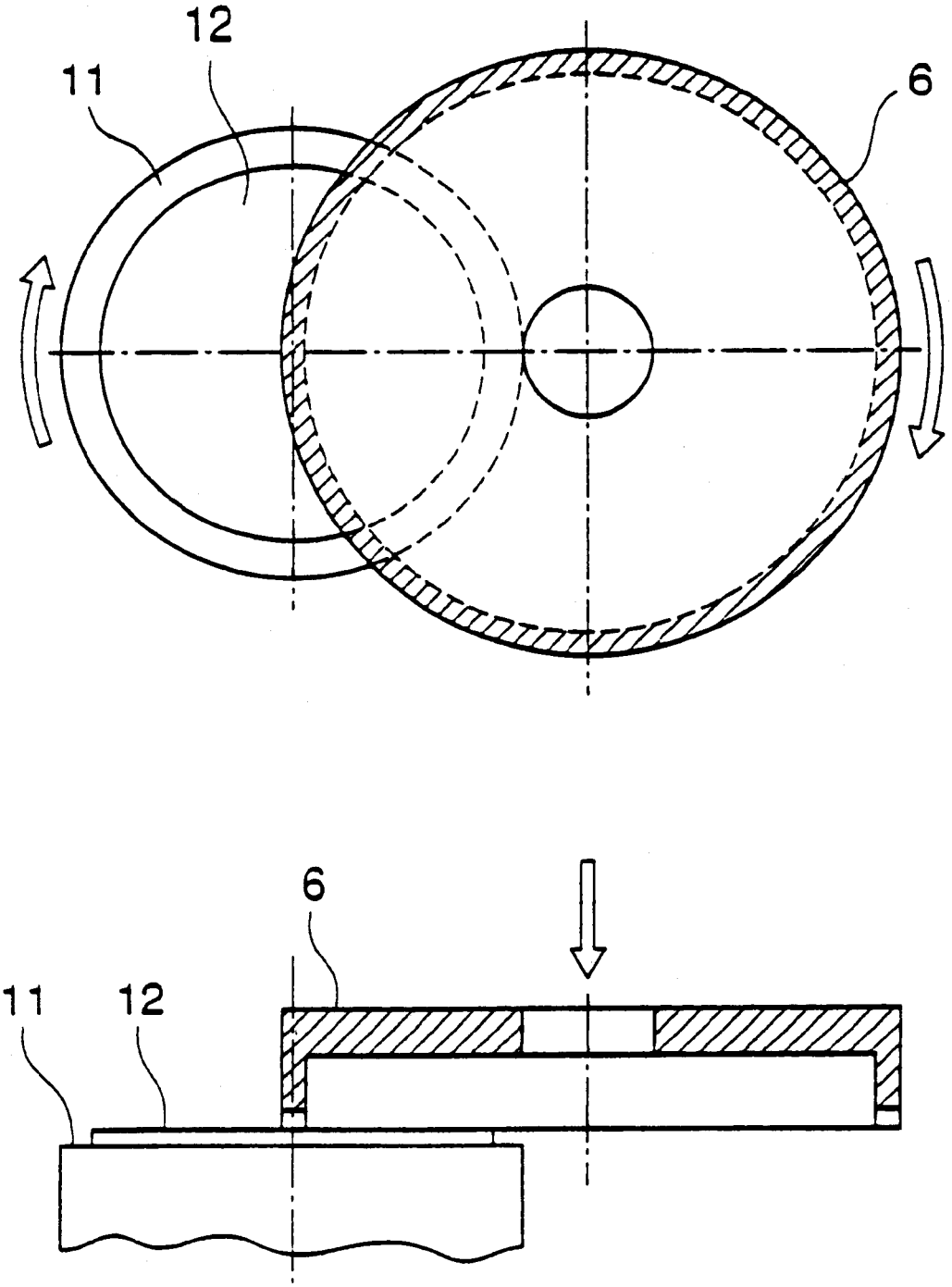
FIG. 5 PRIOR ART
FIG. 5 is a view showing the fundamental workings of a wafer surface grinding method to which the present invention is applied, wherein 3 indicates a grinding wheel shaft support member, 4 a pivotal shaft portion, 5 a grinding wheel rotary shaft, 6 a grinding wheel, 9 a control motor for inclination of a grinding wheel shaft, 11 a table, 12 an object to be processed (wafer), 13 a rotary shaft of the table, 14 a control device for shaft inclination and 15 a corrective angle storage device.

Below, an embodiment of the present invention will illustratively described with reference to the accompanying drawings. It should be understood, however, that sizes, material, shapes, relative positions and the like of structural constituents described in the embodiment are not intended to limit the scope of the present invention to them as far as specific description is not particularly given, but shown for an exemplary purpose only. The same constituents or constituents of the same functions as those in FIG. 5 are indicated by the same marks.

Figure 1:
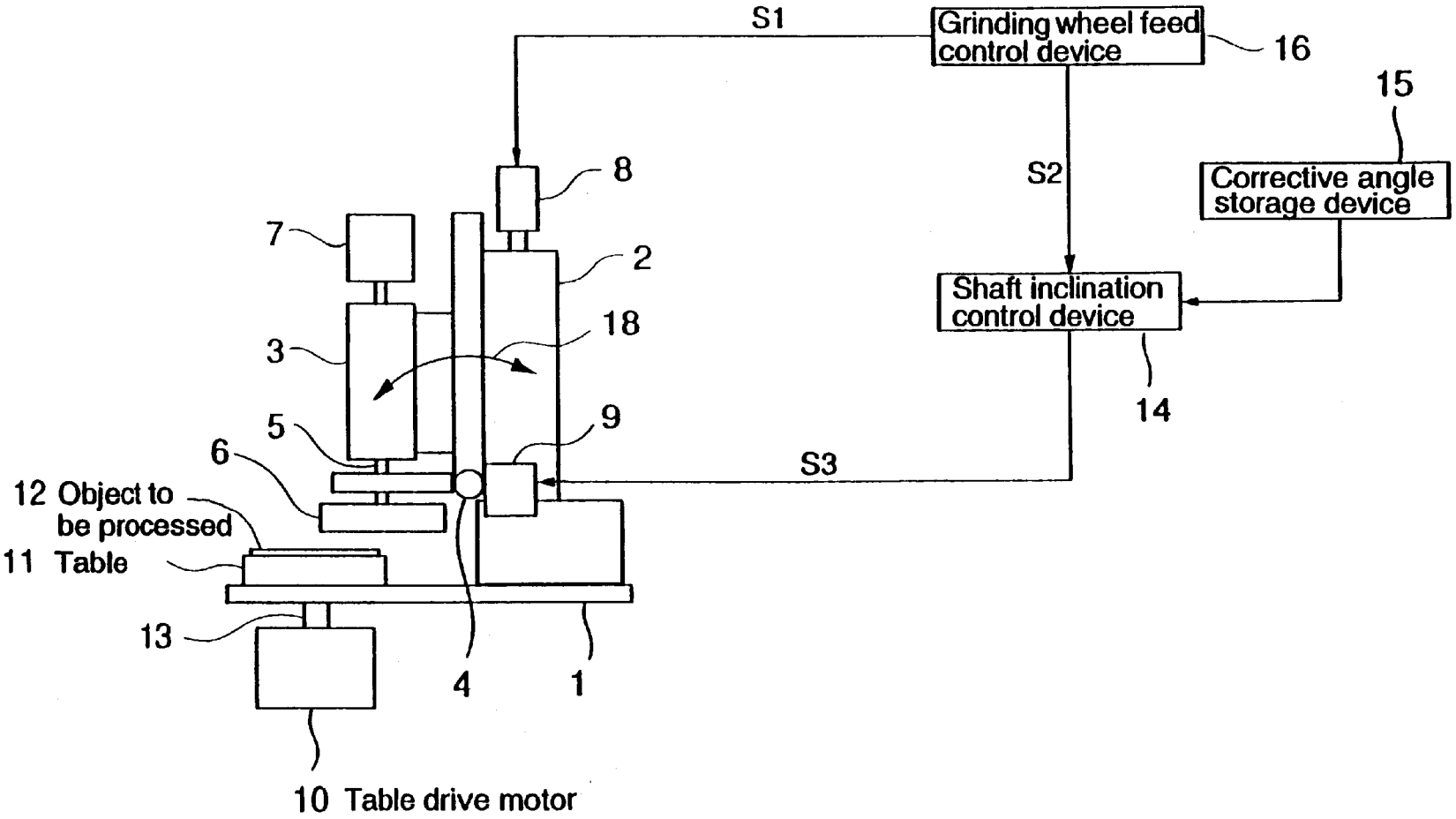
FIG. 1 is a construction schematically showing an embodiment of a surface grinding apparatus for a thin plate work of the present invention, FIGS. 2(*a*) to 2(*c*) are representations for illustrating actions which show cutting modes of a grinding wheel according to a method of the present invention and respectively correspond to the stages in high rate feed, low rate feed and spark-out, FIGS. 3(*a*) to 3(*c*) are representations for illustrating actions which show cutting modes of a grinding wheel when no corrections are applied and respectively correspond to the stages in high rate feed, low rate feed and spark-out, FIGS. 4(*a*) to 4(*c*) are representations for illustrating actions which show cutting modes of a grinding wheel in application of general shape correction means according to a comparative method of the present invention in which an initial correction of a grinding wheel inclination angle is effected and respectively correspond to the stages in high rate feed, low rate feed and spark-out
Figure 2A:
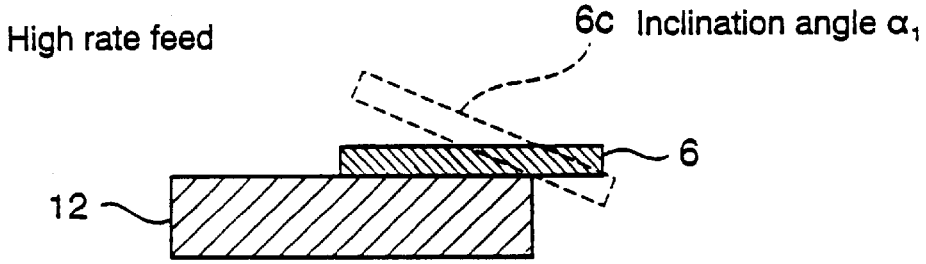
Figure 2B:
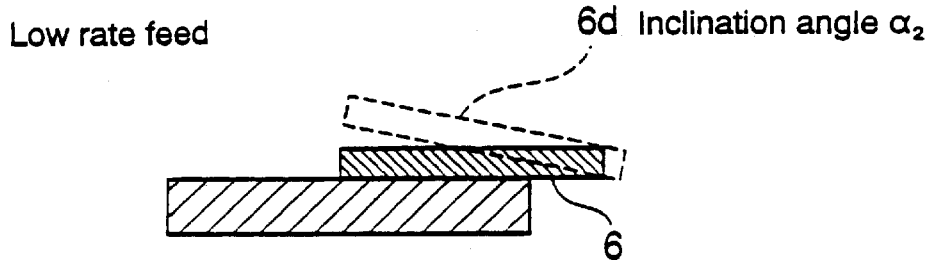
Figure 2C:
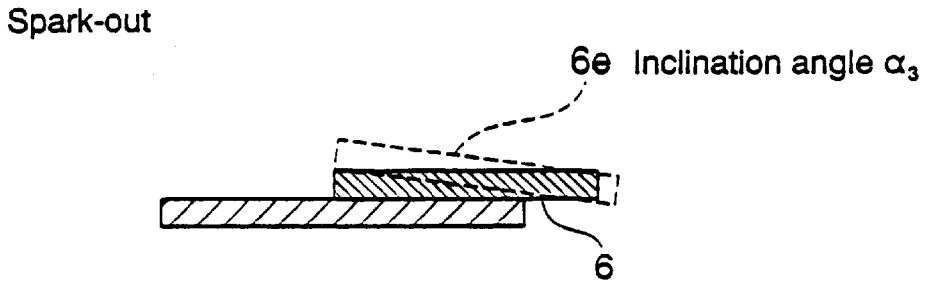
Figure 3A:
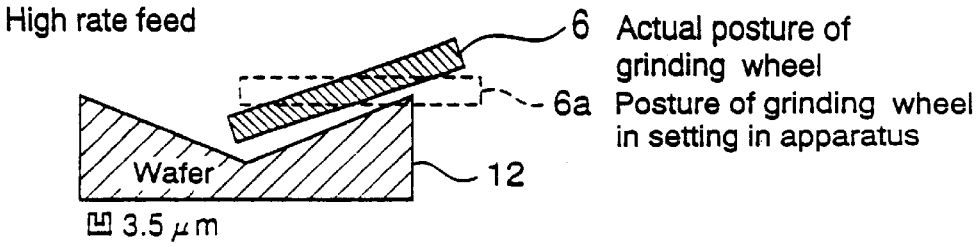
FIG. 3(a) PRIOR ART
Figure 3B:
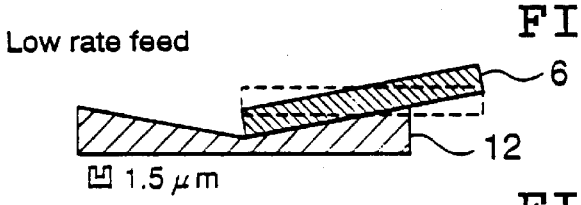
FIG. 3(b) PRIOR ART
Figure 3C:
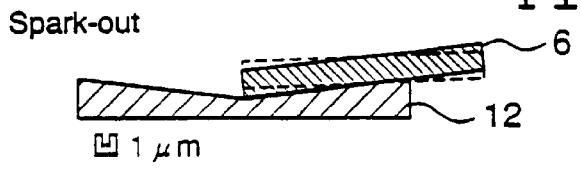
FIG. 3(c) PRIOR ART

FIG. 1 shows a surface grinding apparatus which is an embodiment of the present invention. In the figure, a fixed frame 2 is provided in the right side of a base 1 and a grinding wheel shaft support member 3 is held by the fixed frame 2 in a manner such that the support member 3 can be oscillated along an arrow 18 direction with the help of a pivotal shaft portion 4. A rotary shaft 5 on whose fore-end a grinding wheel 6 is fixed is supported by the grinding wheel support member 3 and the rotary shaft 5 is driven by a grinding wheel shaft drive motor 7. Not only is the grinding wheel 6 is vertically moved by a grinding wheel shaft vertically shifting motor 8 which is provided on the top portion of the fixed frame 2, but the pivotal shaft portion 4 can arbitrarily set an inclination angle of the grinding wheel 6 rotary shaft 5 by rotation control of the control motor 9 for inclination of the grinding wheel shaft.

A table 11 mounted on a rotary shaft 13 of a table drive motor 10 is provided in the left side of the base 1 in the figure. A wafer 12 is fixedly held on the table 11.

A grinding wheel feed control device 16 sends a feed rate signal S1 of the grinding wheel shaft to the grinding wheel shaft vertically shifting motor 8 and by control of the motor 8, the grinding wheel feed rate can be controlled not only in travel till a normal grinding start position, but in three stage feed rates (depth of cut), that is high rate feed, low rate feed and spark-out (no feed).

A numerical mark 15 is a corrective angle storage device in which corrective angles of grinding wheel inclination in the grinding steps of the high rate feed, the low rate feed and the spark-out are stored, and corrective angles when feed rates are changed (at completion of each grinding step) are values which are set by confirming wafer shapes at the settings or changes of grinding wheels, or at the starts of run of the grinding apparatus in the respective grinding steps in advance.

A corresponding corrective angle is sent out to a shaft inclination control device 14 by a feed rate change signal S2 from the grinding wheel feed control device 16.

The shaft inclination control device 14 reads a corresponding shaft inclination corrective angle from the corrective angle storage device 15 based on the feed rate change signal S2 from the grinding wheel feed control apparatus 16, sends a motor drive signal S3 corresponding to the corrective angle to the control motor 9 for inclination of a grinding wheel shaft and further controls an inclination angle of the rotary shaft 5 of the grinding wheel 3 (to the rotary shaft 13 of the table 11) by activating the pivotal shaft portion 4.

Operations of the embodiment will be described in a concrete manner.

Corrective angles of grinding wheel inclination angle corresponding to the grinding wheel inclination angle $\alpha_1$, $\alpha_2$, $\alpha_3$ which have been obtained in the description in SUMMARY OF THE INVENTION are stored in the corrective angle storage device 15.

The grinding wheel inclination angle $\alpha_1$ is read from the corrective angle storage device 15 by the shaft inclination control device 14 at the start of the high rate feed, a motor drive signal S3 corresponding to the corrective angle is sent to the grinding wheel shaft inclination control motor 9, whereby the high rate feed (depth of cut) is effected in a state in which the grinding wheel is inclined by the inclination angle $\alpha_1$.

Then, in transition to the low rate feed (depth of cut), a shaft inclination corrective angle corresponding to the grinding wheel inclination angle $\alpha_2$ is read from the corrective angle storage device 15 by the shaft inclination control device 14 based on a feed rate change signal S2 from the grinding wheel feed control device 16 and a motor drive signal S3 corresponding to the corrective angle is sent to the grinding wheel shaft inclination control motor 9, whereby the low rate feed (depth of cut) is effected while the inclination angle $\alpha_1$, of the grinding wheel 3 is changed to $\alpha_2$.

In the spark-out as the last step, the spark-out is effected after a grinding wheel inclination angle is changed from $\alpha_2$ to $\alpha_3$ as is same as the above described ways.

In such a embodiment, a surface flatness of the wafer 12 in an intermediate stage of the grinding was measured when each grinding step had been finished and a very good flatness equal to or less than 1 $\mu$m in TTV was obtained in each of the respective grinding steps.

Figure 4A:
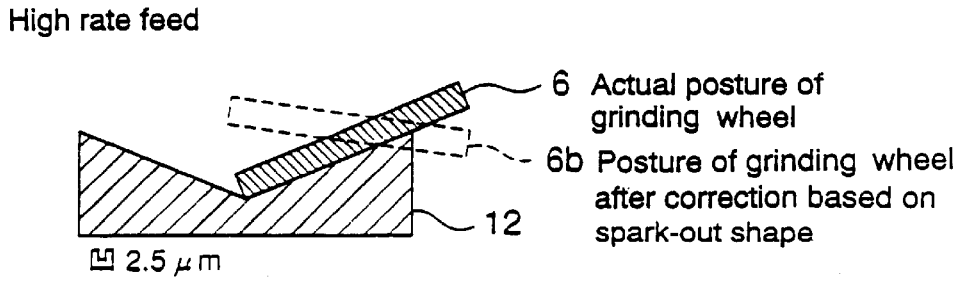
FIG. 4(a) PRIOR ART
Figure 4B:
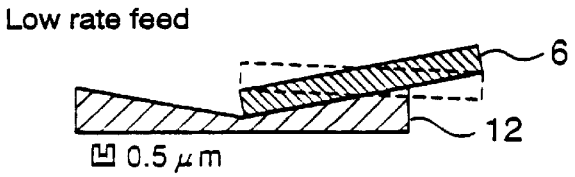
FIG. 4(b) PRIOR ART
Figure 4C:
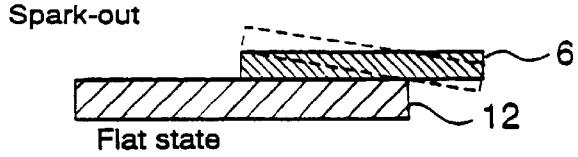
FIG. 4(c) PRIOR ART

Then, as a comparative example, after an initial correction of an inclination angle shown in FIG. 4 is effected prior to the grinding, the grinding of three stage, that is the high rate feed, the low rate feed and the sparkout are performed.

A ground stock removal in the low rate feed was decreased, in a concrete manner halved from 3 $\mu$m to 1.5 $\mu$m, and an effect of decrease in the ground stock removal was confirmed in order to conduct comparison between the comparative grinding method and a corrective method of the present invention in which grinding wheel inclination angles were respectively changed so as to approach a horizontal direction as a grinding step is transited from the high rate feed, to the low rate feed and to the spark-out.

As a result, a concavity of 2.5 $\mu$m of the wafer 12 which had been subjected to the high rate feed of the comparative grinding method was unable to remove by the removal of the order of 1.5 $\mu$m, but a concavity of the wafer remained to be equal to or more than 1 $\mu$m after the removal. On the other hand, in the method of the present invention in which adjustment was effected so as to secure a wafer flatness at a desired arbitrary time, the wafer showed a flat state even when a grinding stock removal was decreased and since straight grinding at a high feed rate was performed close to a final thickness desired and a removal in grinding at a low feed rate was enabled to be smaller, a time of grinding was able to be decreased. Besides, a necessary time for the spark-out was also decreased by about 40%.

In company with the effects described above, a load on the grinding wheel was alleviated and as a result extension of a lifetime of the grinding wheel was able to be confirmed in addition to a shorter time of processing.

While description on the correction of inclination based on the figures, for example description of FIG.1, is directed to correction in the direction from left to right as viewed on the figure, another capability to perform correction in the direction from front to back as viewed on the figure (sheet) is provided according to a form and condition of a grinding wheel (a rotational direction of a grinding wheel, a way to operate a grinding wheel and a difference in other grinding conditions). In addition, a relative angle between the shaft of a grinding wheel and a work may be corrected by control in the table side of the object to be processed.

EFFECTS OF THE INVENTION

As detailed above, according to the present invention, since a grinding wheel inclination angle is changed in each of grinding steps during grinding, not only can a high flatness of a work be achieved, but a shorter processing time, decrease in necessary grinding removal of the work and extension of the lifetime can be realized, whereby high accuracy processing of a thin plate work such as a wafer can be performed with a high flatness of the finished work.

What is claimed is:

1. A surface grinding method for a thin plate workpiece wherein a rotating, cup-shaped grinding wheel is pressed against the thin plate workpiece, said thin plate workpiece being supported on a table and rotating while the thin plate workpiece is ground by the grinding wheel, wherein a feed rate of the grinding wheel is changed step-wise during grinding, and an angle of inclination of the grinding wheel relative to the thin plate workpiece is also changed at substantially the same time the feed rate of the grinding wheel is changed.

2. A surface grinding method for a thin plate workpiece wherein a rotating, cup-shaped grinding wheel is pressed against the thin plate workpiece, said thin plate workpiece being supported on a table and rotating while the thin plate workpiece is ground by the grinding wheel, wherein a feed rate of the grinding wheel is changed step-wise during grinding, and an angle of inclination of the grinding wheel relative to the thin plate workpiece is also changed at substantially the same time the feed rate of the grinding wheel is changed, the feed rate of the grinding wheel being changed in multiple stages of high feed rate, low feed rate and no feed, and the relative angle of inclination of the grinding wheel to the thin plate workpiece being changed by a preset inclination corrective angle in each of the stages in which the feed rate is changed, whereby the surface of the thin plate workpiece is ground to an arbitrary target shape.

3. A surface grinding method for a thin plate workpiece according to claim 2, wherein when the thin plate workpiece is processed in the high feed rate, the low feed rate and the no feed stages, respective first, second and third inclination corrective angles are set which are inclined downwardly toward the periphery of the thin plate workpiece, and the respective inclination corrective angles are used sequentially for correction so that successive inclination corrective angles are closer to a horizontal direction.

4. A surface grinding apparatus which presses a rotating, cup-shaped grinding wheel against a thin plate workpiece which is to be processed, said grinding wheel being supported on a shaft and said workpiece being supported on a table and rotating while the thin plate workpiece is ground by the grinding wheel, a feed rate of the grinding wheel being changed step-wise during grinding, said apparatus comprising:

a grinding wheel feed rate adjuster for changing the feed rate of the grinding wheel stepwise;

a corrective angle store for storing a corrective angle for an inclination angle of the grinding wheel in each grinding step corresponding to a respective feed rate of the grinding wheel; and a shaft inclination controller for controlling the inclination angle of the grinding wheel shaft relative to the thin plate workpiece in accordance with the corrective angle which is read from the corrective angle store, wherein the inclination angle of the grinding wheel shaft is changed by the shaft inclination controller for each of the grinding steps corresponding to the respective feed rates of the grinding wheel and the inclination angle and the feed rate are changed simultaneously.

* * * * *